US005765315A

United States Patent [19]

Nagamitsu et al.

[11] Patent Number: 5,765,315

[45] Date of Patent: Jun. 16, 1998

[54] SPACE-SAVING WORKING EQUIPMENT

[75] Inventors: Satoshi Nagamitsu, Higashiyamato; Hidemi Yaguchi, Mitsukaido; Yuji Yoshida, Yawara-mura, all of Japan

[73] Assignee: Okamura Corporation, Japan

[21] Appl. No.: 784,036

[22] Filed: Jan. 16, 1997

[30] Foreign Application Priority Data

| | | | |
|---|---|---|---|
| Jan. 18, 1996 | [JP] | Japan | 8-006329 |
| Jan. 18, 1996 | [JP] | Japan | 8-006330 |
| Jan. 18, 1996 | [JP] | Japan | 8-006331 |
| Jan. 18, 1996 | [JP] | Japan | 8-006334 |

[51] Int. Cl.[6] ..... A47B 87/00

[52] U.S. Cl. ..... 52/36.1; 52/33; 52/239; 108/64; 108/92; 108/50.01

[58] Field of Search ..... 52/33, 36.1, 239; 108/50.01, 50.11, 50.17, 64, 91, 92, 93; 312/239, 196

[56] References Cited

U.S. PATENT DOCUMENTS

| | | | |
|---|---|---|---|
| 3,276,881 | 10/1966 | Saggione | 108/64 |
| 3,588,210 | 6/1971 | Des Marais | 312/196 |
| 5,129,200 | 7/1992 | Kaneko | 52/36.1 |
| 5,277,130 | 1/1994 | Caporrella | 108/64 X |
| 5,438,937 | 8/1995 | Ball et al. | 108/64 |
| 5,704,298 | 1/1998 | Corpuz, Jr. et al. | 108/64 X |

FOREIGN PATENT DOCUMENTS 62-41644 10/1987 Japan .

*Primary Examiner*—Robert Canfield
*Attorney, Agent, or Firm*—Graham & James LLP

[57] ABSTRACT

To save space in an office when a personal computer is operated or when a conference is held with a number of persons, a working table which has a concave portion at the front edge and a auxiliary table are used. A plurality of the working tables and auxiliary tables are arranged side by side and surrounded by a partition to form a working room. The auxiliary table is placed by the working table and is movable with casters at the ends of feet of the auxiliary table. The height of the auxiliary table is variable, so that it is disposed with the working table at the same height for conference in the office, or is stored under the working table when the auxiliary table is not used. On a board which is slidably mounted on a panel at the rear end of the table, information or schedule may be written. The working room surrounded by the partition has a roll screen, and the workers can discuss various matters, watching an image on the roll screen projected by a projector.

6 Claims, 9 Drawing Sheets

SPACE-SAVING WORKING EQUIPMENT

BACKGROUND OF THE INVENTION

The present invention relates to a space-saving working equipment, and particularly to a working table, a combination of a working table and an auxiliary table and a space-saving working equipment suitable to team working to increase working efficiency of a team in product development, planning and sales departments, thereby saving space in an office.

To increase intellectual productivity in an office and to obtain competitive force which is a core for a corporation, the most important object is to achieve excellent teamwork among strategic staff members of development and planning departments which readily create business seed, and to provide sales team which has customer-emphasizing principle.

Therefore, it is required to save space in an office which provides mobility suitable for team working and usable as a space for conference, limited space being shared as one team. In a conventional office, a plurality of desks which have rectangular tops are arranged side by side and faced to form a working area for workers in a team. Between the two desk rows, space for a large conference table is provided.

In the foregoing prior art, the front edge of the rectangular tops of the desk row which are arranged side by side extends straight, and adjacent workers sit down on chairs side by side. But the worker is distracted from his work by other's eyes.

To prevent it, a screen for concealing their schedules on the desk is provided upwards of the tops of the desks or forwards of the front edge of the tops. But such a screen is liable to block communication among members and to make it difficult to have a personal computer on the desk for common use.

A large conference table between desk rows decreases office space, and walking of the workers are obstructed. Such large conference table blocks communication among the workers who generally face data and a display of the personal computer to damage a unity as team.

The conference table is disposed in another place such as a conference room, but the workers must move to the room even for simple consultation. Such movement interrupts working, thereby making it difficult for the team or other members to join the conference freely. During working at his own desk, it is impossible for members who do not join the conference to obtain information of the conference. So, it is unsuitable for teamwork.

Also, in front of a screen panel, a writing or notice board is attached or a movable board is stood, or as disclosed in Japanese Utility Model Pub. No.62-41644, on the front surface of furniture, a horizontally movable board such as a writing board is suspended, on which information, schedule or speech in a conference is written.

On the side or rear surface of the screen panel which surrounds the desk, a board is suspended, or a movable board is placed against an adjacent desk to decrease space around the desk. If the board is too close to the side or rear surface of the worker, he is liable to be hitted with the board, which is dangerous. If the board is placed on the rear surface of the desk, his hand does not reach the board unless he stands up and extends his arm. The board can be used only by the worker, but idea or discussion cannot be written or corrected by an adjacent worker.

On the front surface of furniture, instead of sliding door, a board is suspended movably in a horizontal direction. The furniture is usually placed with a screen panel, far from a working area. Thus, the worker is left from his own seat, and his working is interrupted to decrease efficiency.

Even if the furniture is placed around the worker, he must turn his head to write on the board, and cannot work with confirming matters written on the board.

A sliding board instead of a sliding door in the furniture is made to a large size, and it is noisy during movement in a horizontal direction, so that working is interrupted.

A working room is known, in which the desk rows each of which comprises a plurality of desks side by side are placed at a certain distance. On the rear and side surfaces of the desk rows, a panel which stands on the desk is provided, and workers in one team sit down back to back, and turn their heads. Discussion can be made with workers of opposing desk row. An entrance is formed between panels which are provided at the side of the desks.

In the prior art, if a door is not provided at the entrance for the working room, even persons who do not belong to the team enter the working room freely. So a working space where person can concentrate or suitable secret area can not be constructed. If the door is provided for the entrance, the working room becomes closed space.

To provide a path where they can come and go freely between back-to-back workers, total space in the working room must be increased. The entrance and the door for the entrance must be broadened.

To discuss various matters among the team based on a projector, space for discussion is required, but there is no place for projector or screen, so that all members must move to a conference room.

SUMMARY OF THE INVENTION

An object of the present invention is to provide a working table and a combination of the working table and an auxiliary table which are suitable for each working and are capable of changing arrangement suitable to team working, thereby saving office space.

Another object of the present invention is to provide a working equipment which is suitable for each working and is capable of changing arrangement suitable for team working.

Further object of the present invention is to provide a table with a sliding board which is provided within reach of a worker, the board being slidable to increase working efficiency.

According to one aspect of the present invention, there is provided a working table which has a roughly rectangular top a front edge of which has a concave portion and a convex portion to form a wave, the top having equal width at each side end, a tangent at one side end being inclined at an equal angle to a tangent at the other side end with respect to a straight line between the side ends.

The working tables which have similar wave forms at the front edges are arranged side by side to form a uniform working space. The worker faces the concave front edge of the working table to save space of the office. Without being distracted by other's eyes, he can concentrate his work.

According to another aspect of the present invention, there is provided a combination of a working table and a movable auxiliary table, the working table which has a roughly rectangular top a front edge of which has a concave portion and a convex portion to form a wave, the top having equal width at each side end, a tangent at one side end being inclined at an equal angle to a tangent at the other side end with respect to a straight line between the side ends, the auxiliary table having a roughly triangular top, a top of the auxiliary table being slightly lower than a top of the working table.

According to further aspect of the present invention, there is provided a space saving working equipment in which a plurality of working tables each of which has a concave portion at a front edge of a top are arranged side by side to form a plurality of table rows, a plurality of auxiliary tables each of which has a concave portion at a front edge being attached, the auxiliary tables being capable of being stored under the working tables.

When the worker leaves his seat or comes home, the auxiliary table can be stored under the working table. In use, the auxiliary table is pulled out to form "L" shape with the working table. The auxiliary table is separated from the working table and used between the workers. The concave portion of the auxiliary table is connected with the concave portion of the working table, so that office space is not extremely decreased.

The worker faces the concave portion of the top of the working table, so that he can concentrate his work without being distracted by other's eyes. A broad path space for a conference is formed between the two table rows. The worker can come and go in the path, and can discuss various matters based on data on the table, display, a board and a roll screen.

When all workers discuss business matters, a desired number of the auxiliary tables are taken out to conference space to form a desired arrangement. Persons who do not belong to the team can join the conference.

BRIEF DESCRIPTION OF THE DRAWINGS

The features and advantages of the present invention will become more apparent from the following description with respect to embodiments based on the appended drawings wherein.

DETAILED DESCRIPTION OF PREFERRED EMBODIMENTS

Figure 1:
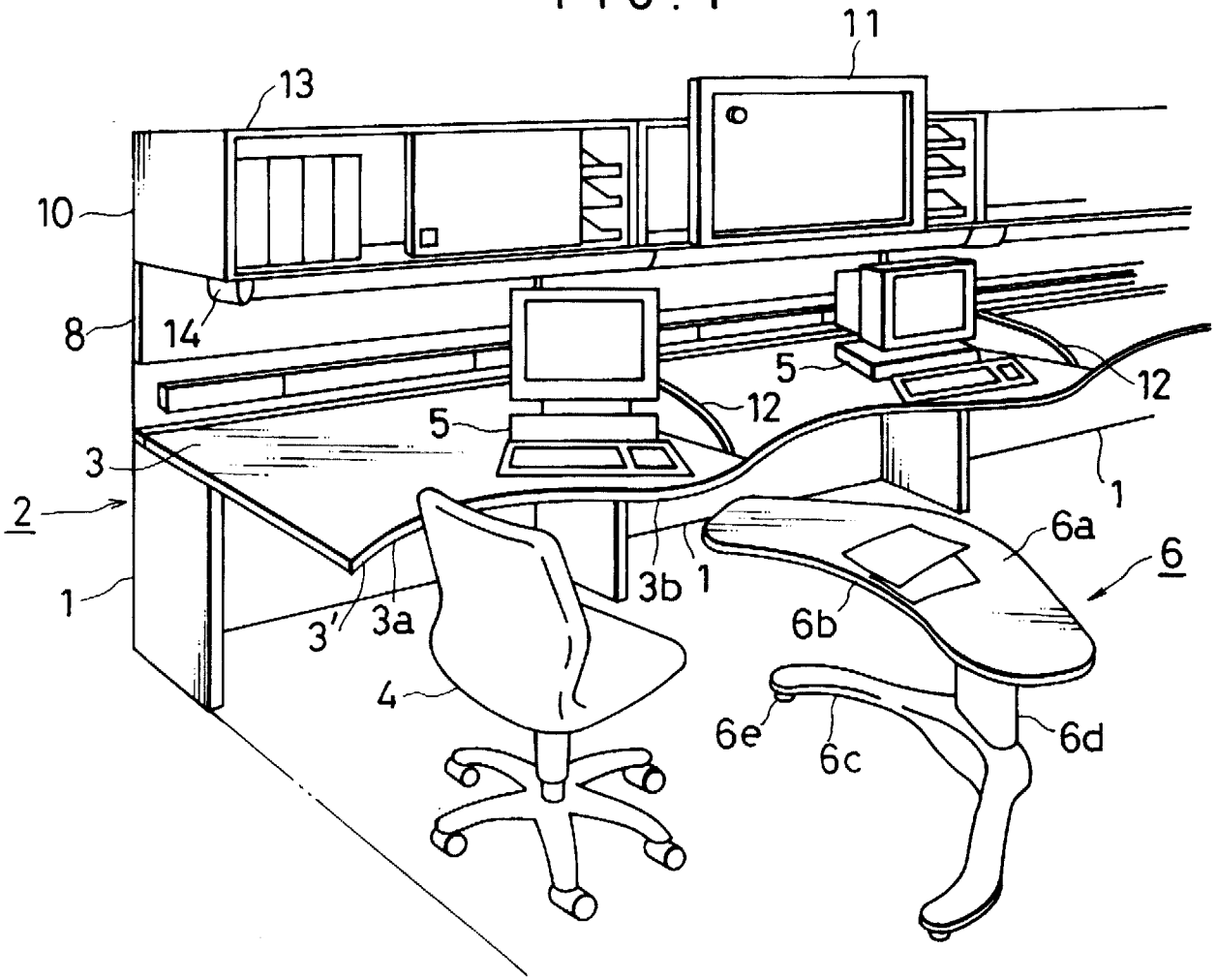
FIG. 1 is a perspective view of a working equipment according to the present invention, in which partitions at entrances are removed.

As shown in FIG. 1, a working table 1 comprises a top 3, and the front edge 3' of the top 3 is wave-formed. In the wave-formed front edge 3', a concave portion 3*a* and a convex portion 3*b* are formed. Generally, in front of the concave portion 3*a* of the top 4, a worker sits down on a chair 4, and office equipment such as a personal computer 5 is placed on the convex portion 3*b* of the top 3.

In the table 1, the end of the front edge 3' of the top 3 is fitted with the end of the front edge of a top 3 of an adjacent table 1, or the end of the concave portion 3*a* is continuously connected with the end of the convex portion 3*b*. Thus, the front edges 3' of the table group 2 are formed as a smooth curve.

Figure 2:
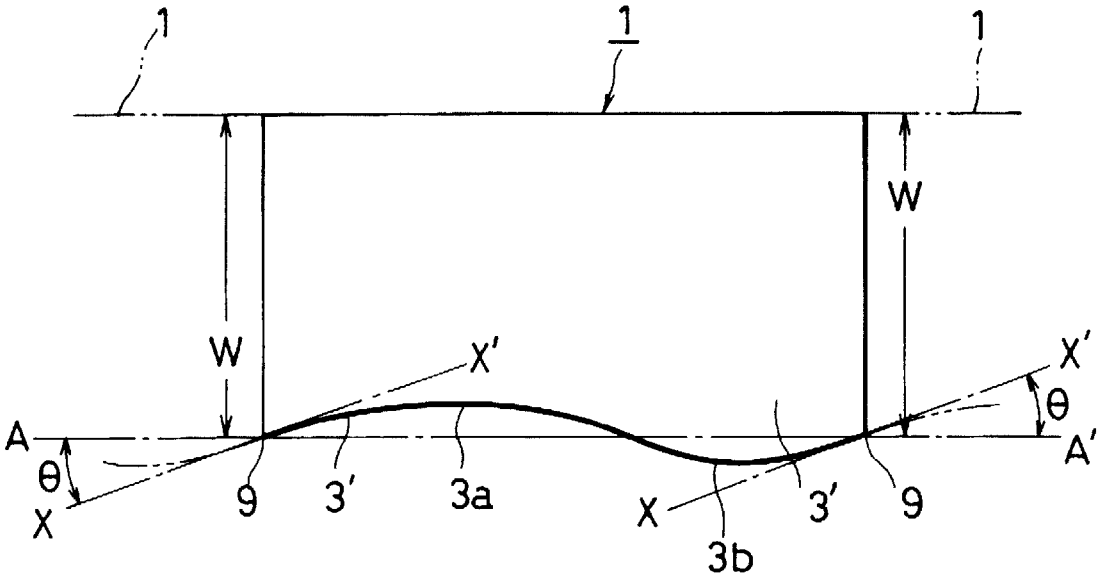
FIG. 2 is a top plan view of a working table according to the present invention.

As illustrated in FIG. 2, the width "W" at the side ends is equal, and angles θ of tangents of a curved line at the side end 9 of the front edge 3' to a line A-A' (a straight line between the side ends 9) are equal.

By the table 1, a movable auxiliary table 6 is provided. The auxiliary table 6 has a top 6*a* the upper surface of which is slightly lower than the lower surface of the top 3 of the table 1, and the top 6*a* has a rough triangle which has round corners and a concave portion 6*b*.

As illustrated in FIG. 1, the auxiliary table 6 has feet 6*c* which are similar to the concave portion 6*b* of the top 6*a*. A leg 6*d* of the auxiliary table 6 has a lifting mechanism for moving the top 6*a* up and down. The auxiliary table 6 is movable with casters 6*b* at the ends of the feet 6*c*.

Figure 6:
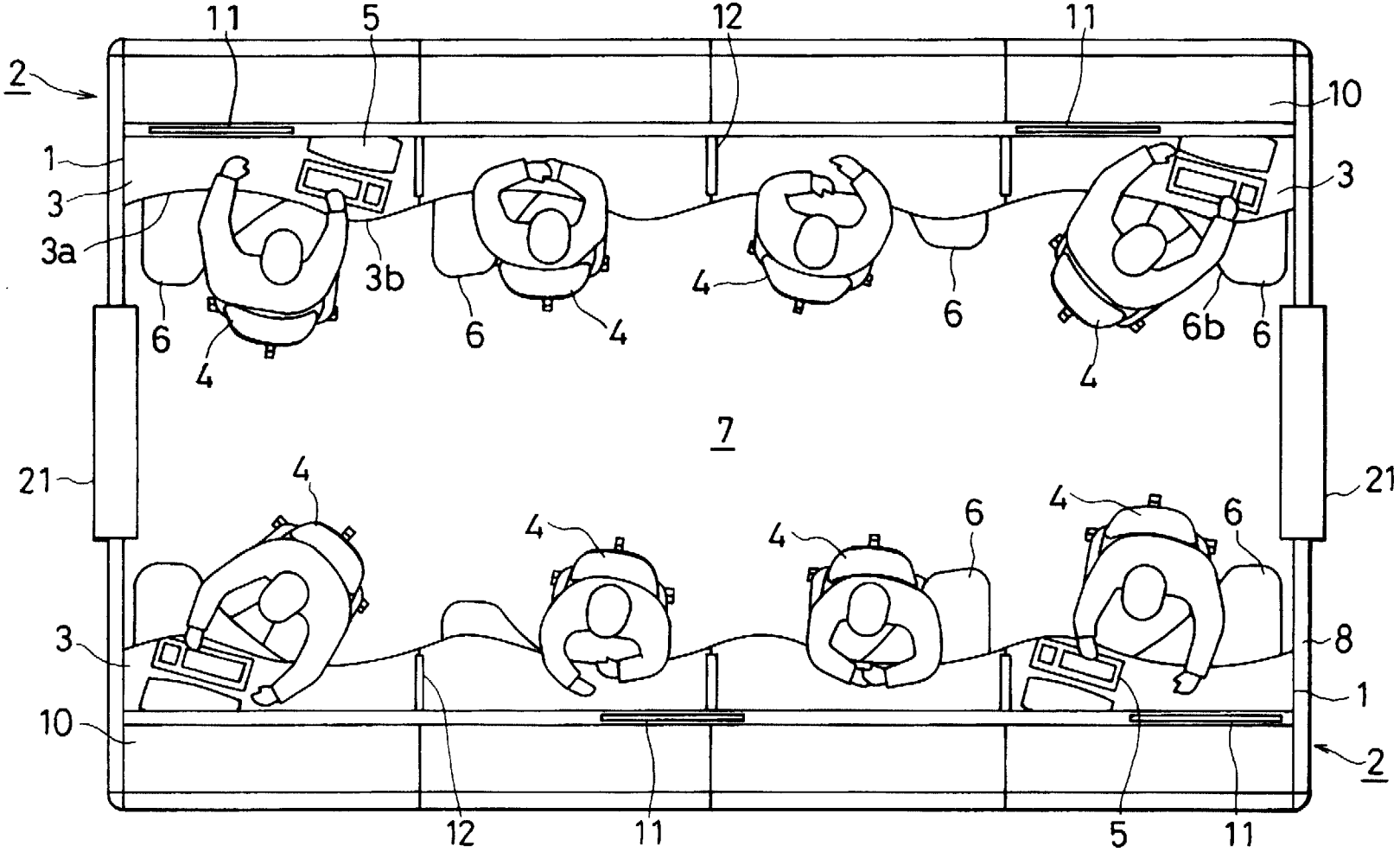
FIG. 6 is a top plan view which shows a basic working condition of one embodiment of a working equipment according to the present invention.

As shown in FIG. 6, the tables 2 are arranged such that the backs of the workers in two rows are faced, and a middle path 7 is provided in the room. Working space which comprises the eight tables 1 in one team thus made is surrounded by a partition 8.

The partition 8 has entrances 21 which communicates with the path 7. The partition 8 which surrounds the working space has a plurality of struts which extend from the floor to the ceiling, and has a panel and entrances.

As shown in FIG. 1, above each of the tables 1, a cabinet 10 is mounted to the partition 8 or the table 1. The numeral 11 denotes a board which is slidable in a horizontal direction so that workers may have it for common use. The numeral 12 denotes a small simple partition between adjacent tables. The board 11 is, for example, a blackboard or whiteboard, and is slidable along a rail 13 above the cabinet 10.

Figure 3:
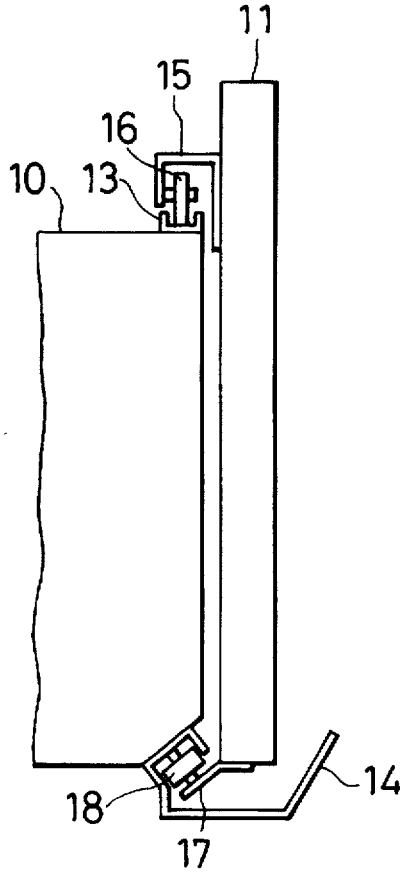
FIG. 3 is an enlarged side view of a board in FIG. 1.

As shown in FIG. 3, in the vicinity of each end of the upper rear surface of the board 11, a roller 16 is mounted via a fitting 15 to run on the rail 13. Under the board 11, a rail 14 which can also receive chalk powder in case of a blackboard is slidable in a horizontal direction. The board 11 is suspended from the cabinet 10 via the roller 16. A roller 18 is mounted by a fitting 17 at about 45 degrees at the lower end of the board 11. The roller 18 is received in a roller receiving portion of the rail 14 at a chamferred portion of the cabinet 10 to guide the board 11. The front end of the rail 14 is projected under the board 11. Thus, the board 11 is slid via the rail 13 in a horizontal direction to an adjacent table 1, and is usable by an adjacent worker.

Figure 4:
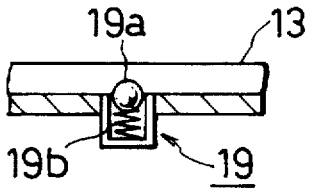
FIG. 4 is an enlarged vertical sectional view of means for temporalily stopping a board mounted to a rail.
Figure 5:
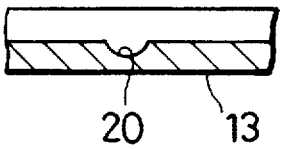
FIG. 5 is an enlarged vertical sectional view of a variation of temporalily stopping means in FIG. 4.

To stop the board 11 temporarily, as shown in FIG. 4, a ball catcher 19 is embedded so that a ball 19*a* is pushed out of the surface of the rail 13 by a spring 19*b*. When the roller 16 is engaged on the ball 19*a*, the board 11 is temporarily stopped. The board 11 is further pushed, and the roller 16 pushes the ball 19*a* down against force of the spring 19*b*. In another embodiment as shown in FIG. 5, to stop the board 11 temporarily, the rail 13 has a bore 20. The roller 16 of the board 11 is engaged in the bore 20, so that the board 11 temporalily stops. The board 11 is further pushed, and the roller 16 is moved over the bore 20.

By stopping the board 11, the board 11 is fixed temporarily, and anything can be written on the board. The board which is slid in a horizontal direction is prevented from hitting an adjacent worker carelessly.

Figure 7:
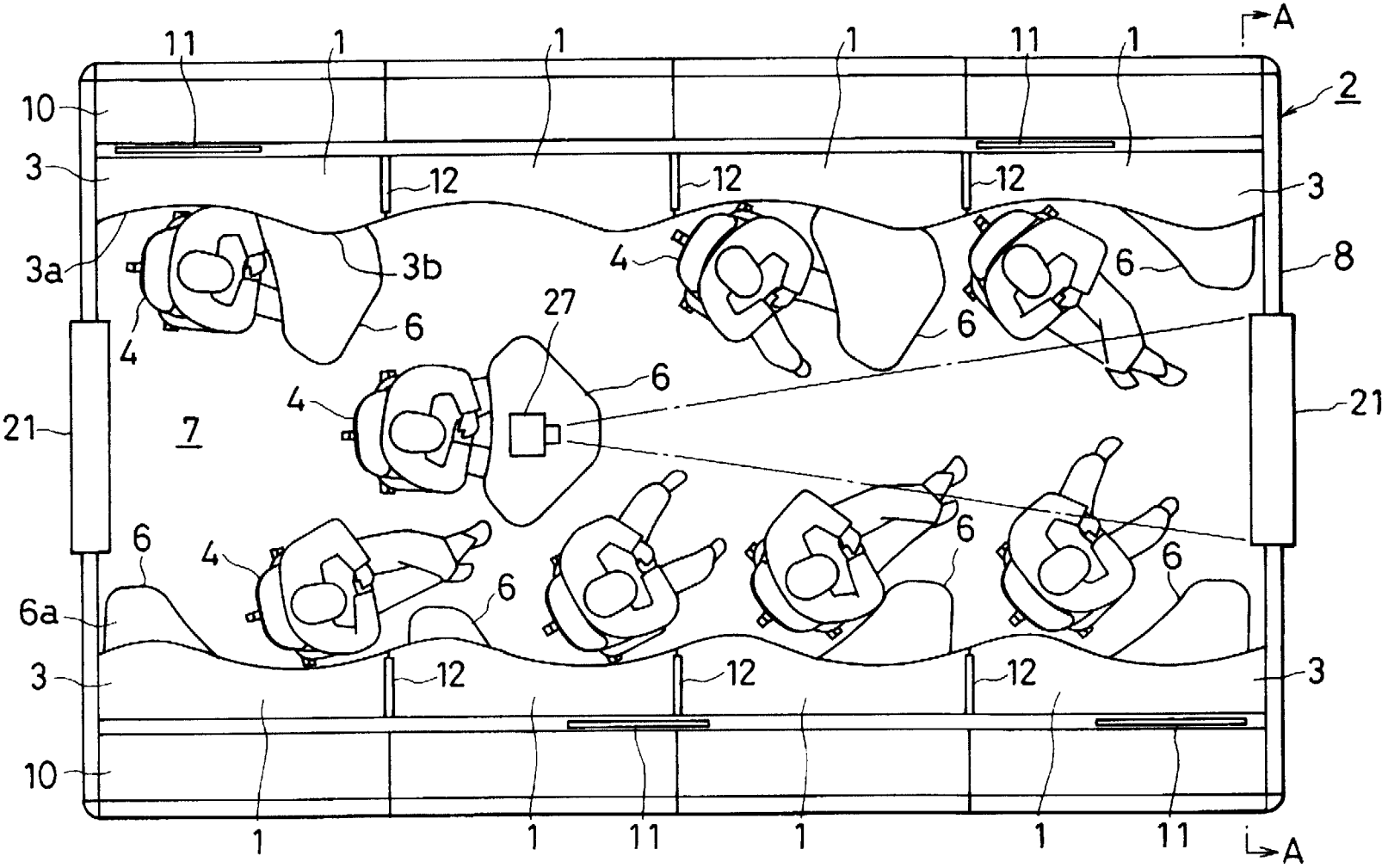
FIG. 7 is a top plan view of a working room which has a roll screen.
Figure 10:
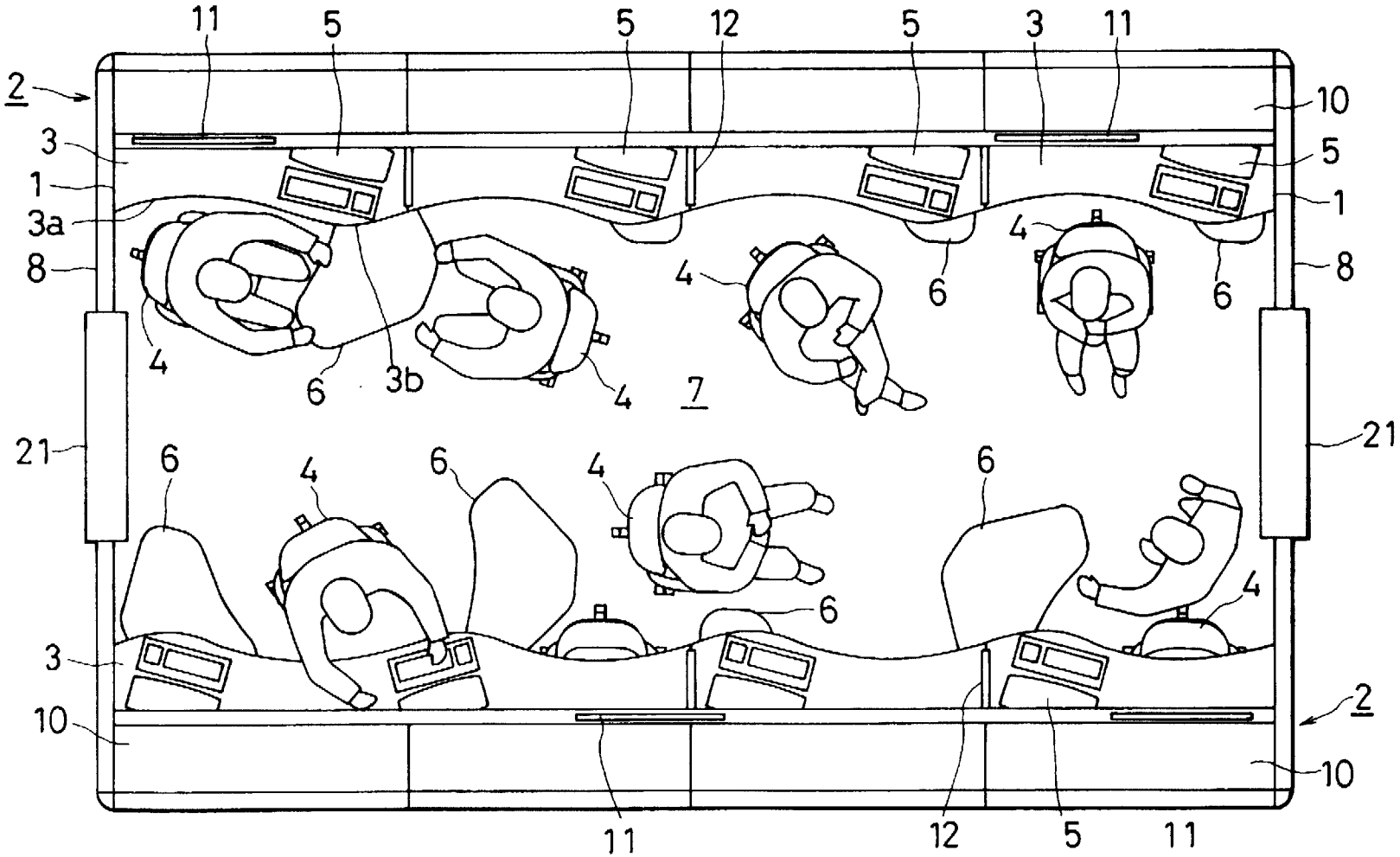
FIG. 10 is a top plan view which shows discussion and working in the working equipment in FIG. 6.
Figure 11:
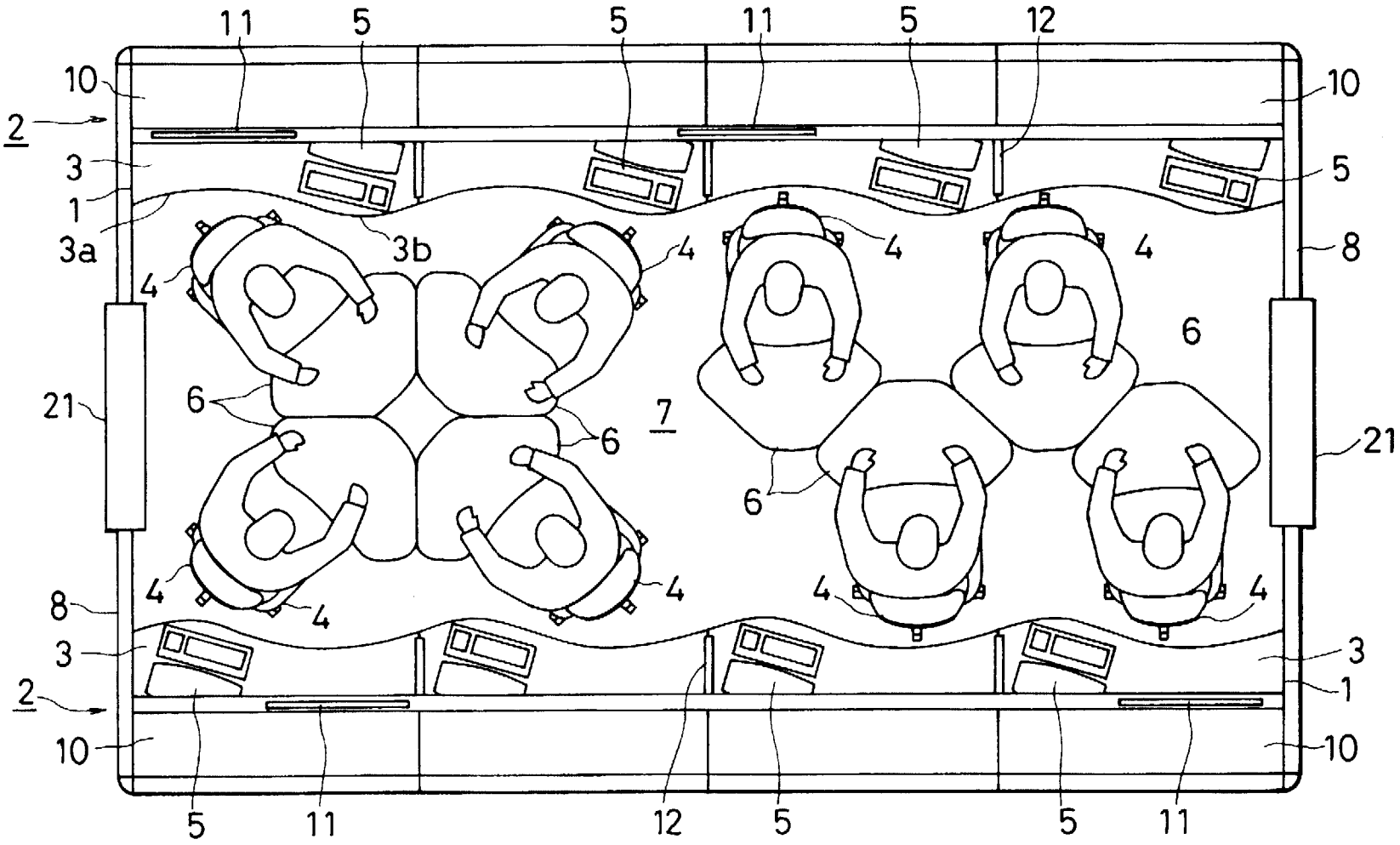
FIG. 11 is a top plan view which shows discussion each group in FIG. 6.

FIG. 6 illustrates a basic working arrangement of the team, and FIGS. 7, 10 and 11 illustrate various arrangements of a working space of the team. As shown in FIG. 6, four tables 1 are arranged side by side, and two-row workers sit down back to back to provide a middle path.

The working space which contains eight tables in one team is surrounded by the partition 8. The entrances 21 are provided to communicate with the path 7 in the partition 8.

As shown in FIGS. 1 and 6, the auxiliary tables 6 can be partially or wholly stored under the top 3 of the table 1. When the auxiliary table 6 is partially taken out, the convex portion 6*b* of the auxiliary table 6 is brought close to the worker, but the auxiliary table 6 does not obstruct feet of the worker, which is advantageous.

FIG. 7 illustrates one embodiment of a working room which has a roll screen. The tables 1 are arranged side by side to constitute a table row 2. The workers which face the tables 1 in the table row 2 usually sit down back to back in the two rows.

Figure 8:
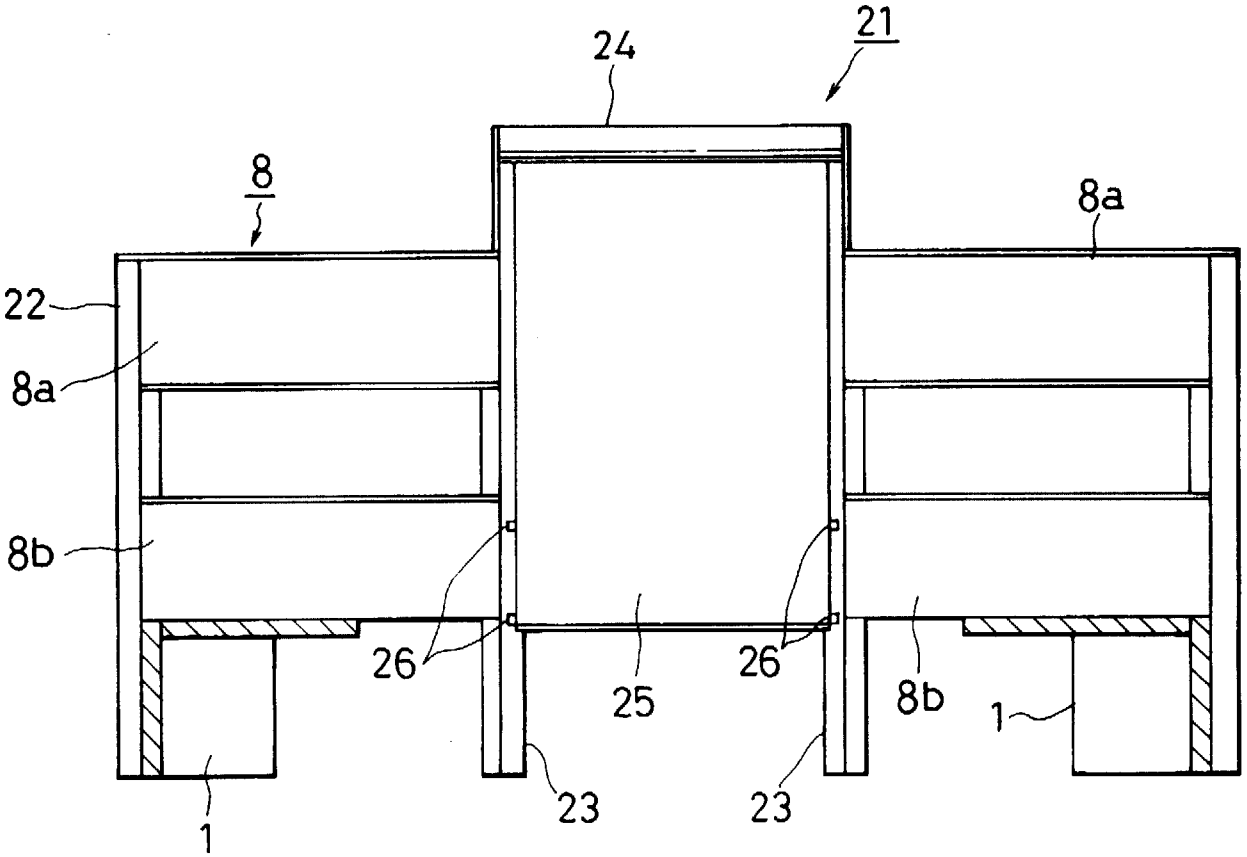
FIG. 8 is a sectional view taken along the line A—A in FIG. 7.
Figure 9:
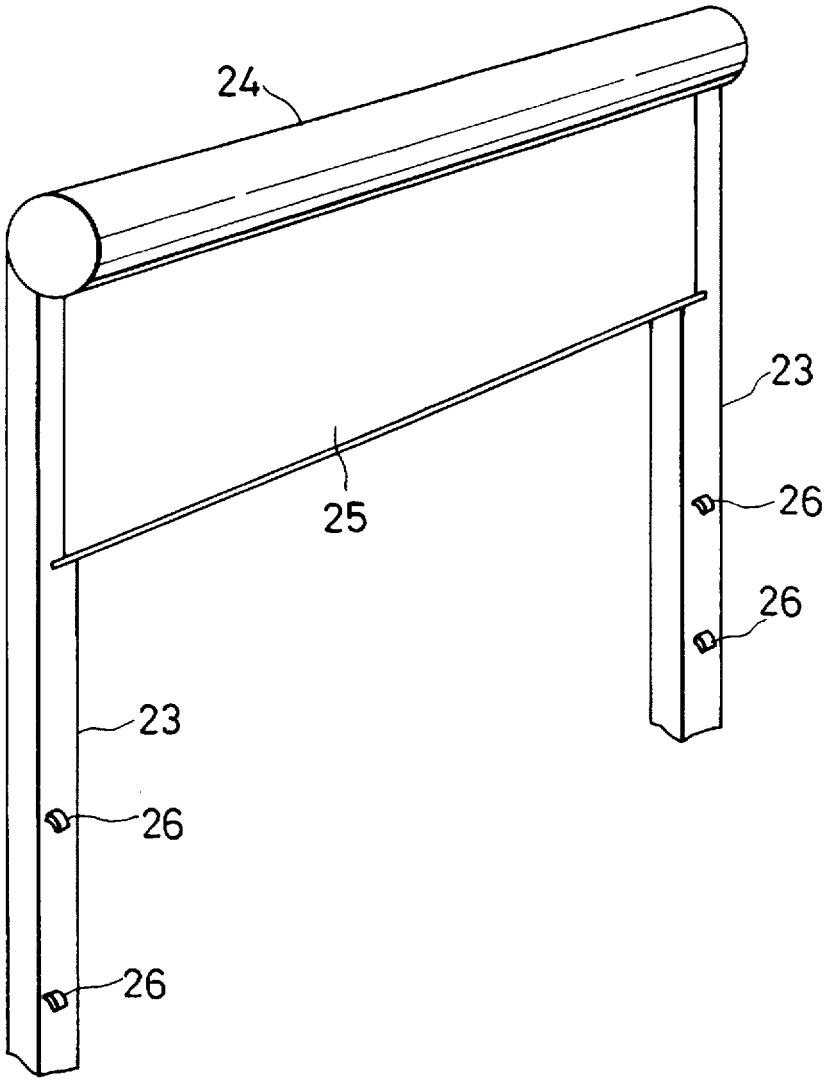
FIG. 9 is a perspective view of a roll screen receiving box and side posts.

In this embodiment, as shown in FIG. 8, the partition 8 for forming the working room comprises upper and lower panels 8*a* and 8*b* between struts 22. The partition 8 is provided along the table 1 at the rear side of the table row 2, and there are provided two side posts 23 to form an entrance 21 which communicates with the middle path between the two table rows.

On a beam (not shown) for connecting the upper ends of the two side posts 23, a roll screen receiving box 24 is mounted. A screen 25 which is wound up in the receiving box 24 is pulled down against force of an inner spring, and is held by engaging with hooks 26 which are mounted at a plurality of different heights of the side posts 23.

The entrance 21 is easily blinded or closed by the screen 25 which is pulled down. As shown in FIG. 7, an image is projected on the screen from an overhead projector 27 on the auxiliary table 6 which is movable in the path 7 for discussion in the team.

In FIG. 10, the auxiliary tables 6 are pulled out, and four persons at the right side argue in the team. Two persons in the upper left side make discussion, and one person in the lower left side operates a personal computer, using the upper surface of adjacent table. In FIG. 11, each four persons in right and left sides have a conference at different arrangement of the auxiliary tables 6.

The foregoings merely relate to embodiments of the invention. Various changes and modifications may be made by person skilled in the art without departing from the scope of claims wherein:

What is claimed is:

1. A space saving working equipment system having a plurality of working tables each of which has a concave portion at a front edge of a top arranged side by side to form a plurality of table rows and a plurality of auxiliary tables each of which has a concave portion at a front edge, the auxiliary tables being capable of being stored under the working tables.

2. The space saving working equipment system as defined in claim 1 wherein at least some of the working tables are arranged side by side to form a continuous wave form at the front edge of the top of said at least some working tables, and the auxiliary tables having a roughly triangular top, one said auxiliary table provided per each working table.

3. The space saving working equipment system as defined in claim 1 wherein two table rows which comprise the same number of the tables are arranged to provide a path between the two table rows such that workers may sit down back to back, the two table rows being partitioned except an entrance which communicates with the path.

4. The space saving working equipment system as defined in claim 1 wherein a cabinet for storing papers is provided above each of the working tables.

5. The space saving working equipment system as defined in claim 3 wherein a box for receiving a roll screen is provided on the entrance which is closed by a suspended roll screen.

6. The space saving working equipment system as defined in claim 5 wherein hooks for engagement with the roll screen are provided at a plurality of different height positions of at the entrance.

* * * * *